US009409214B2

(12) United States Patent
Jang et al.

(10) Patent No.: US 9,409,214 B2
(45) Date of Patent: Aug. 9, 2016

(54) APPARATUS FOR CLEANING SUBSTRATE

(71) Applicant: Samsung Display Co., Ltd., Yongin, Gyeonggi-Do (KR)

(72) Inventors: Euiyun Jang, Seoul (KR); Sang-Gu Lee, Hwaseong-si (KR); Yun Jang, Hwaseong-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 0 days.

(21) Appl. No.: 14/683,921

(22) Filed: Apr. 10, 2015

(65) Prior Publication Data

US 2016/0096208 A1 Apr. 7, 2016

(30) Foreign Application Priority Data

Oct. 2, 2014 (KR) ..... 10-2014-0133355

(51) Int. Cl.

*B08B 5/04* (2006.01)
*A47L 9/12* (2006.01)
*A47L 9/20* (2006.01)

(52) U.S. Cl.

CPC ... *B08B 5/04* (2013.01); *A47L 9/12* (2013.01); *A47L 9/20* (2013.01)

(58) Field of Classification Search

CPC ..... B08B 5/04; A47L 5/12; A47L 5/24; A47L 5/28; A47L 9/20; A47L 9/22; A47L 9/28

See application file for complete search history.

(56) References Cited

U.S. PATENT DOCUMENTS

| | | | | |
|---|---|---|---|---|
| 6,990,704 | B2 * | 1/2006 | Namba | B08B 1/04 134/902 |
| 7,931,755 | B2 * | 4/2011 | Nishio | B08B 5/023 134/36 |
| 8,194,606 | B2 | 6/2012 | Kim et al. | |
| 8,197,606 | B2 | 6/2012 | Watanabe et al. | |
| 8,684,014 | B2 | 4/2014 | Amano et al. | |
| 9,099,298 | B2 * | 8/2015 | Dobashi | H01L 21/67051 |
| 2006/0278160 | A1 | 12/2006 | Su et al. | |
| 2007/0240743 | A1 * | 10/2007 | Hiroe | H01L 21/67017 134/94.1 |
| 2008/0053488 | A1 * | 3/2008 | Uchida | H01K 21/67051 134/32 |

(Continued)

FOREIGN PATENT DOCUMENTS

| | | | |
|---|---|---|---|
| JP | 2002-244115 | A | 8/2002 |
| JP | 2012-163830 | A | 8/2012 |

(Continued)

*Primary Examiner* — Dung Van Nguyen

(74) *Attorney, Agent, or Firm* — Robert E. Bushnell, Esq.

(57) ABSTRACT

An apparatus for cleaning a substrate includes a suction unit generating a suction force, a suction head suctioning contamination particles remaining on the substrate that is transferred in a first direction by using the suction force, and a suction tube connected to the suction unit and the suction head so as to transfer the suction force into the suction head and providing the contamination particles suctioned by the suction head into the suction unit. The suction head may include: a plurality of suction regions arranged in a second direction crossing the first direction; and a plurality of shutters for opening and closing the suction regions. The suction regions corresponding to a width of the substrate in the second direction are opened by the shutters so as to suction the contamination particles.

20 Claims, 5 Drawing Sheets

(56) References Cited

U.S. PATENT DOCUMENTS

| | | | | |
|---|---|---|---|---|
| 2008/0282500 | A1* | 11/2008 | Omagari | B08B 5/02 15/415.1 |
| 2013/0074873 | A1* | 3/2013 | Kitagawa | H01L 21/67028 134/6 |
| 2014/0041689 | A1 | 2/2014 | Namba | |
| 2014/0190530 | A1 | 7/2014 | Maeda et al. | |
| 2014/0248782 | A1 | 9/2014 | Ishibashi | |
| 2014/0299163 | A1 | 10/2014 | Ishibashi | |
| 2014/0331440 | A1 | 11/2014 | Ishibashi | |

FOREIGN PATENT DOCUMENTS

| | | | |
|---|---|---|---|
| KR | 10-2005-0061861 | A | 6/2005 |
| KR | 10-2007-0056720 | A | 6/2007 |
| KR | 10-2007-0081838 | A | 8/2007 |
| KR | 10-0934922 | B1 | 12/2009 |
| KR | 10-2010-0062134 | A | 6/2010 |
| KR | 10-1114726 | B1 | 2/2012 |
| KR | 10-2012-0091757 | A | 8/2012 |
| KR | 10-1361564 | B1 | 2/2014 |
| KR | 10-1375348 | B1 | 3/2014 |

* cited by examiner

APPARATUS FOR CLEANING SUBSTRATE

CLAIM OF PRIORITY

This U.S. non-provisional patent application claims priority under 35 U.S.C. §119 of Korean Patent Application No. 10-2014-0133355, filed on Oct. 2, 2014, the entire contents of which are hereby incorporated by reference.

BACKGROUND OF THE INVENTION

The present invention relates to a display device, and more particularly, to an apparatus for cleaning a substrate, which is capable of efficiently cleaning the substrate.

In general, when display devices are manufactured, thin film devices are formed on a substrate, and then a surface treatment process is performed on the substrate. When the surface treatment process is performed, a cleaning process for cleaning the substrate is performed. The substrate cleaning process is classified into a chemical cleaning method and a physical cleaning method.

The chemical cleaning method is a method of removing foreign substances remaining on a substrate by using a cleaning solution. The physical cleaning method is classified into a contact method and a non-contact method. The contact method is a method of removing foreign substances remaining on a substrate by mechanical contact. The non-contact method is a method in which high-pressure steam is sprayed onto a substrate to blow the foreign substances on the substrate off, and then a suction device suctions and removes the foreign substances.

In the case of the chemical cleaning method, an acid or alkali-based cleaning solution is used to generate environmental pollution. In the case of the contact method, a surface of the substrate may be damaged. In the case of the non-contact method, the foreign substances accumulate on a filter for filtering the suctioned foreign substances to reduce a suction force of the suction device.

SUMMARY OF THE INVENTION

The present invention comprises an apparatus for cleaning a substrate, which is capable of efficiently cleaning the substrate.

Embodiments of the invention provide apparatuses for cleaning a substrate, the apparatuses including: a suction unit generating a suction force; a suction head suctioning contamination particles remaining on the substrate that are transferred in a first direction by using the suction force; and a suction tube connected to the suction unit and the suction head to transfer the suction force into the suction head and providing the contamination particles suctioned by the suction head into the suction unit. The suction head includes: a plurality of suction regions arranged in a second direction crossing the first direction; and a plurality of shutters for opening and closing the suction regions; wherein the suction regions corresponding to a width of the substrate in the second direction are opened by the shutters to suction the contamination particles.

In some embodiments, each of the shutters may include a first shutter and a second shutter that are reciprocated in the first direction, and the first and second shutters may move in a direction opposite to each other.

In other embodiments, the suction head may further include a plurality of partition walls for partitioning the suction head into the suction regions.

In still other embodiments, the suction unit may include: a suction force generation part for generating the suction force; a filter having a closed loop shape, the filter filtering the contamination particles; first and second roller parts disposed with the suction force generation part therebetween in the second direction to move the filter in a predetermined direction; and a third roller part disposed adjacent to the first roller part so as to remove the contamination particles adsorbed onto the filter; wherein the filter may move via a lower portion of the suction force generation part.

In even other embodiments, the suction force generation part may include a rotor.

In yet other embodiments, the filter may be a porous filter.

In further embodiments, the first roller part may include: a first roller generating a rotation force; a second roller disposed lower than the first roller; and a third roller disposed lower than the second roller; wherein each of the first, second and third rollers may have a cylindrical shape extending in the first direction, the second roller is disposed more adjacent to the suction force generation part than the first roller, and the third roller overlaps the first roller in a third direction crossing the first and second directions.

In still further embodiments, the lowermost spot of an outer circumferential surface of the second roller may be disposed lower than a bottom surface of the suction force generation part.

In even further embodiments, the second roller part may include fourth, fifth, and sixth rollers that respectively correspond to the first, second, and third rollers, each of the fourth, fifth, and sixth rollers may have the same shape as that of each of the first, second, and third rollers corresponding thereto, and may be symmetrical to each of the first, second, and third rollers corresponding thereto with respect to the suction force generation part in the second direction, and the filter may move along an outer circumferential surface of each of the first to sixth rollers in a predetermined direction by rotation of each of the first to sixth rollers.

In yet further embodiments, the filter may contact an upper outer circumferential surface of the first roller, a right-lower outer circumferential surface of the second roller, a right-lower outer circumferential surface of the third roller, an upper outer circumferential surface of the fourth roller, a left-lower outer circumferential surface of the fifth roller, and a left-lower outer circumferential surface of the sixth roller so as to move.

In much further embodiments, the first, third, fourth, and sixth rollers may rotate in a first rotation direction, and the second and fifth rollers may rotate in a second rotation direction which is opposite to the first rotation direction.

In still much further embodiments, each of the first to third rollers may have a width greater than that of the filter in the first direction, and the filter may have a width greater than that of the suction force generation part in the first direction.

In even much further embodiments, the third roller part may include: a seventh roller disposed adjacent to the first roller; and an adhesion member disposed on an outer circumferential surface of the seventh roller; wherein the seventh roller may rotate in a direction opposite to that of the first roller, and the adhesion member may be in contact with the filter that moves by means of the first roller.

In yet much further embodiments, the contamination particles adsorbed onto the filter moving due to the first roller may be transferred to the adhesion member due to an adhesion force of the adhesion member, and may be removed from the filter.

In some embodiments, the adhesion member may be periodically replaced.

In other embodiments, the suction regions may include: a plurality of first suction regions; a plurality of second suction regions arranged at a left side of the first suction regions in the second direction; and a plurality of third suction regions arranged at a right side of the first suction regions in the second direction.

In still other embodiments, the suction tube may include: a first suction tube connected to the first suction regions and a central portion of a bottom surface of the suction unit; a plurality of second suction tubes connected to the second suction regions corresponding thereto and one side surface of the first suction tube in the second direction; and a plurality of third suction tubes connected to the third suction regions corresponding thereto and the other side surface of the first suction tube in the second direction.

In even other embodiments, the first suction tube may define a moving path through which the contamination particles suctioned from the first suction regions move into the suction unit, the second suction tubes may define moving paths through which the contamination particles suctioned from the second suction regions move into the suction unit, and the third suction tubes may define moving paths through which the contamination particles suctioned from the third suction regions move into the suction unit.

In yet other embodiments, the filter may have a width greater than that of the first suction tube in the first direction.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION OF THE INVENTION

Figure 1:
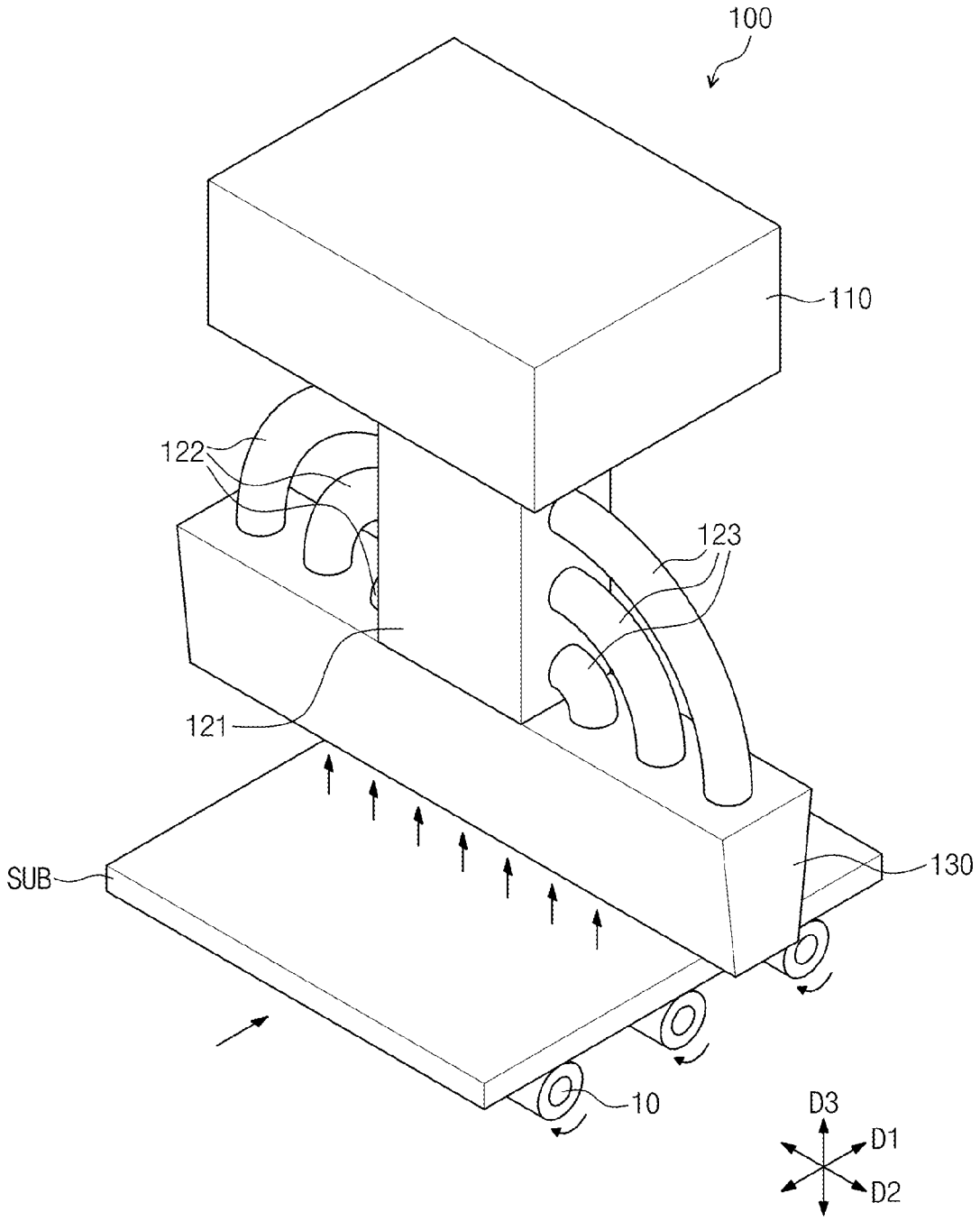
FIG. 1 is a perspective view of a substrate cleaning apparatus according to an embodiment of the present invention.

Advantages and features of the present invention, and implementation methods thereof will be clarified through the following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the embodiment to those skilled in the art. Further, the present disclosure is only defined by the scope of the claims. Like reference numerals refer to like elements throughout.

In the description of embodiments, it will be understood that, when an element or layer (or film) is referred to as being 'on/over' another element or layer, it can be directly on another element or layer, or intervening layers may also be present. On the other hand, if an element is referred to as being 'directly on' another element, it means that no intervening constituent element is present. As used herein, the term "and/or" includes any and all combinations of one or more of the associated listed items.

Terms for representing relative spaces such as below, beneath, lower, above, upper, and so on may be used to easily describe relationships between one element or constitutions and the other element or constitutions as illustrated in the drawings. In addition, the terms for representing relative spaces may be understood as the terms including directions different from each other of the elements when the element is used or operates Like reference numerals refer to like elements throughout.

Although terms like "a first" and "a second" are used to describe various devices, components, and/or sections in various embodiments of the present invention, the devices, components, and/or sections are not limited to these terms. The terms are used only to distinguish an element, constitution, or section from another. Therefore, a first element, a first part, or a first section in an embodiment can be referred to as a second device, a second part, or a second section in another embodiment.

Embodiments of the present invention will be described with reference to plan views and cross-sectional views which are ideal schematic views of the invention. Accordingly, shapes of the exemplary views may be modified according to manufacturing techniques and/or allowable errors. Therefore, the embodiments of the invention are not limited to the specific shape illustrated in the exemplary views, but may include other shapes that may be created according to manufacturing processes. Thus, the regions illustrated in the figures are schematic in nature and their shapes are not intended to illustrate the precise shape of a region of a device and are not intended to limit the scope of the invention.

Hereinafter, embodiments of the invention will be described below in more detail with reference to the accompanying drawings.

FIG. 1 is a perspective view of a substrate cleaning apparatus according to an embodiment of the invention.

Referring to FIG. 1, when a cleaning process is performed, a substrate SUB is disposed under a substrate cleaning apparatus 100. The substrate SUB may be transferred by substrate transfer rollers 10 rotating in a predetermined direction. For example, the substrate SUB may be transferred in a first direction D1 by the substrate transfer rollers 10 rotating in a clockwise direction. The substrate cleaning apparatus 100 may suction and remove contamination particles remaining on the substrate SUB.

Although not shown, the substrate transfer apparatus 100, the substrate SUB, and the substrate transfer rollers 10 may be disposed within a process chamber in which the substrate cleaning process is performed.

The substrate cleaning apparatus 100 according to the invention includes a suction unit 110, suction tubes 121, 122, and 123, and a suction head 130. The suction tubes 121, 122, and 123 are disposed on a lower side of the suction unit 110. The suction head 130 is disposed on lower portions of the suction tubes 121, 122, and 123.

The suction tubes 121, 122, and 123 include a first suction tube 121, a plurality of second suction tubes 122, and a plurality of third suction tubes 123. The first suction tube 121 is disposed between the second suction tubes 122 and the third suction tubes 123 in a second direction D2 that crosses the first direction D1.

The second suction tubes 122 are disposed at a left side of the first suction tube 121 in the second direction D2 and are arranged in the second direction D2. The third suction tubes 123 are disposed at a right side of the first suction tube 121 in the second direction D2 and arranged in the second direction D2.

The first suction tube 121 extends in a third direction D3 that crosses the first and second directions D1 and D2. The first suction tube 121 is connected to a central portion of a bottom surface of the suction unit 110 and to a central portion of a top surface of the suction head 130.

The second suction tubes 122 are connected to one side surface of the first suction tube 121 and to the top surface of the suction head 130 at a left side with respect to the central portion of the suction head 130 in the second direction D2. The third suction tubes 123 are connected to the other side surface of the first suction tube 121 and to the top surface of the suction head 130 at a right side with respect to the central portion of the suction head 130 in the second direction D2.

The suction head 130 extends in the second direction D2. The suction head 130 is disposed above the substrate SUB.

The suction unit 110 generates a suction force. The first to third suction tubes 121, 122, and 123 may transmit the suction force generated from the suction unit 110 into the suction head 130 and define a moving path of the contamination particles.

The suction head 130 receives the suction force through the first to third suction tubes 121, 122, and 123 so as to suction the contamination particles remaining on the substrate SUB. The contamination particles suctioned through the suction head 130 are provided into the suction unit 110 through the first to third suction tubes 121, 122, and 123. The suction unit 110 suctions and removes the contamination particles.

Hereinafter, inner constitutions of each of the suction unit 110, the first to third suction tubes 121, 122, and 123, and the suction head 130 will be described in detail.

Figure 2:
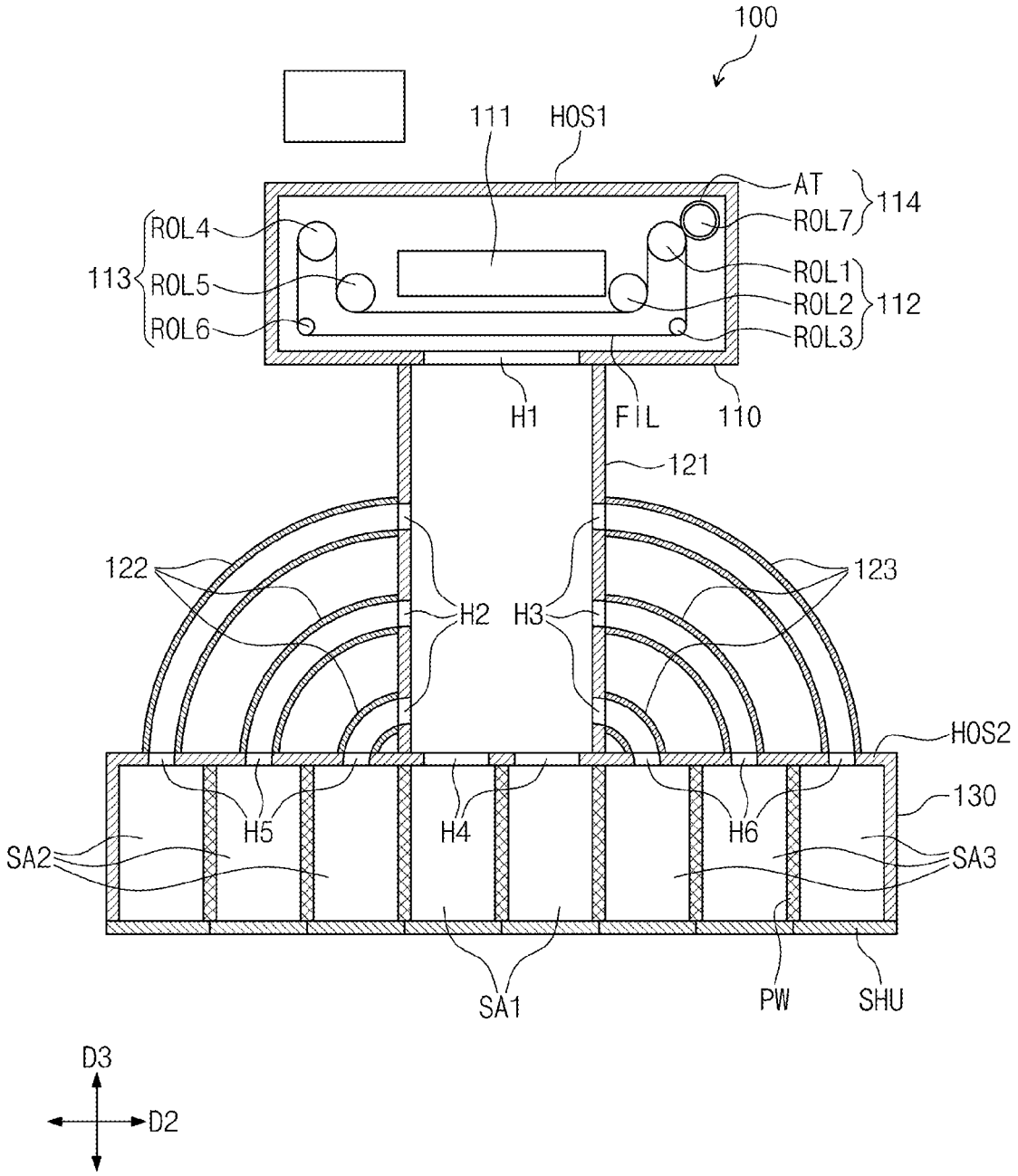
FIG. 2 is a cross-sectional view illustrating inner constitutions of a substrate transfer device when viewed in a first direction.
Figure 3:
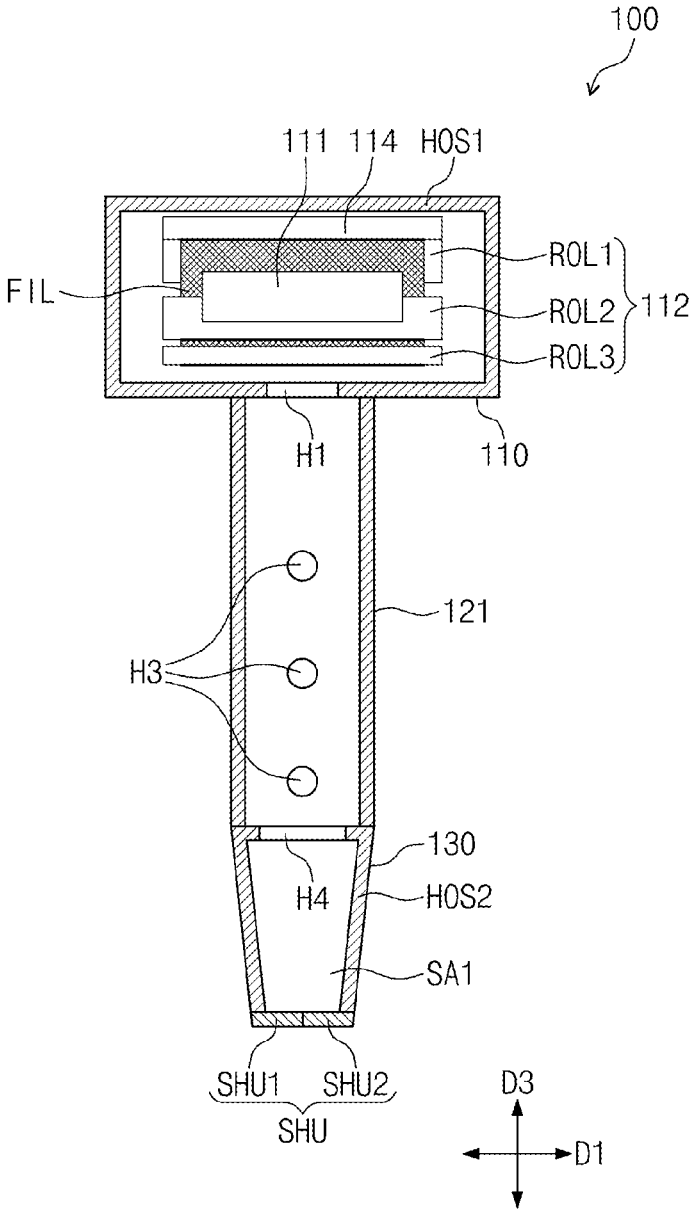
FIG. 3 is a cross-sectional view illustrating inner constitutions of the substrate transfer device when viewed in a second direction.

FIG. 2 is a cross-sectional view illustrating inner constitutions of a substrate transfer device when viewed in a first direction, and FIG. 3 is a cross-sectional view illustrating inner constitutions of the substrate transfer device when viewed in a second direction.

For convenience in description, FIG. 3 illustrates a cross-sectional view of the substrate transfer device 100 when viewed in a direction looking toward the first roller part 112.

Referring to FIGS. 2 and 3, the suction unit 110 includes a first housing HOS1, a suction force generation part 111, a first roller part 112, a second roller part 113, a third roller part 114, and a filter FIL.

The suction force generation part 111, the first, second, and third roller parts 112, 113, and 114, and the filter FIL are accommodated in the first housing HOS1. The first housing HOS1 includes a first hole H1 that is defined so as to correspond to the first suction tube 110.

The suction force generation part 111 generates the suction force upward from a lower side. Although not shown, the suction force generation part 111 includes a rotor (an impeller) generating a suction force.

The first and second roller parts 112 and 113 are disposed with the suction force generation part 111 therebetween in the second direction D2. The first and second roller parts 112 and 113 are symmetrical to each other with respect to the suction force generation part 111 in the second direction D2.

The first and second roller parts 112 and 113 may move the filter FIL having a closed loop shape in a predetermined direction. The filter FIL may move via a lower portion of the suction force generation part 111. The filter FIL may be a porous filter.

The first roller part 112 includes a first roller ROL1, a second roller ROL2, and a third roller ROL3, each of which has a cylindrical shape extending in the first direction D1. Thus, each of the first, second, and third rollers ROL1, ROL2, and ROL3 may have a circular section when viewed in the first direction D1 (perpendicular to both second direction D2 and third direction D3).

As illustrated in FIG. 3, the first, second, and third rollers ROL1, ROL2, and ROL3 may have the same width in the first direction D1. However, it is not limited thereto, and for example, the first, second, and third rollers ROL1, ROL2, and ROL3 may have widths different from each other in the first direction D1. Each of the first, second, and third rollers ROL1, ROL2, and ROL3 has a width greater than that of the suction force generation part 111 in the first direction D1.

The second roller ROL2 is disposed lower than the first roller ROL1. The third roller ROL3 is disposed lower than the second roller ROL2. The second roller ROL2 is disposed more adjacent to the suction force generation part 111 than the first roller ROL1. The third roller ROL3 overlaps the first roller ROL1 in the third direction D3. The second roller ROL2 may have the lowermost spot of an outer circumferential surface thereof which is disposed lower than a bottom surface of the suction force generation part 111.

The second roller part 113 includes fourth, fifth, and sixth rollers ROL4, ROL5, and ROL6 each of which corresponds to a respective one of the first, second, and third rollers ROL1, ROL2, and ROL3.

Each of the fourth, fifth, and sixth rollers ROL4, ROL5, and ROL6 has the same shape as that of each of the first, second, and third rollers ROL1, ROL2, and ROL3 corresponding thereto. Each of the fourth, fifth, and sixth rollers ROL4, ROL5, and ROL6 is symmetrical to each of the first, second, and third rollers ROL1, ROL2, and ROL3 corresponding thereto with respect to the suction force generation part 111 in the second direction D2.

The filter FIL may move along an outer circumferential surface of each of the first to sixth rollers ROL1 to ROL6 in a predetermined direction by a rotation of each of the first to sixth rollers ROL1 to ROL 6.

In detail, the filter FIL contacts an upper outer circumferential surface of the first roller ROL1, a right-lower outer circumferential surface of the second roller ROL2, and a right-lower outer circumferential surface of the third roller ROL3 to move. Also, the filter FIL contacts an upper outer circumferential surface of the fourth roller ROL4, a left-lower outer circumferential surface of the fifth roller ROL5, and a left-lower outer circumferential surface of the sixth roller ROL6 to move.

As illustrated in FIG. 3, the filter FIL has a width that is less than that of each of the first to third rollers ROL1 to ROL3 and that is greater than that of the suction force generation part 111 in the first direction D1. Also, the filter FIL has a width greater than that of the first suction tube 121 in the first direction D1.

The first roller ROL1 may be defined as a driving roller that generates a rotation force in a predetermined rotation direction. Each of the second to sixth rollers ROL2 to ROL6 may be defined as an idler roller that supports the filter FIL and rotates according to a movement of the filter FIL moving by the first roller ROL1.

Hereinafter, the movement of the filter FIL in a predetermined direction by the first to sixth rollers ROL1 to ROL6 will be described in detail with reference to FIG. 5, which is a view illustrating an operation of the substrate cleaning apparatus of FIG. 1.

The third roller part 114 is disposed adjacent to the first roller part 112. In detail, the third roller part 114 includes a seventh roller ROL 7 that is adjacent to the first roller ROL1 and an adhesion member AT disposed on an outer circumferential surface of the seventh roller ROL7. The adhesion member AT may include an adhesion tape.

When the seventh roller ROL 7 rotates, the adhesion member AT rotates together with the seventh roller ROL7. The adhesion member AT is disposed so as to contact the filter FIL moving by the first roller ROL1.

An upper portion of the first suction tube 121 is disposed so as to correspond to the first hole H1 of the first housing HOS1 and is connected to a central portion of a bottom surface of the first housing HOS1.

The first suction tube 121 includes a plurality of second holes H2 defined in one side surface of the first suction tube 121 and a plurality of third holes H3 defined in the other side surface of the first suction tube 121 in the second direction D2. Each of the second and third holes H2 and H3 are arranged at the same interval in the third direction D3.

Each of the second suction tubes 122 has one side that is connected to each of the second holes H2 corresponding thereto. Each of the third suction tubes 123 has one side that is connected to each of the third holes H3 corresponding thereto.

The suction head 130 includes a second housing HOS2, a plurality of partition walls PW, a plurality of suction regions SA1, SA2, and SA3, and a plurality of shutters SHU.

The second housing HOS2 has a top surface connected to the first, second, and third suction tubes 121, 122, and 123. The partition walls PW may partition an inner space of the second housing HOS2 into the plurality of suction regions SA1, SA2, and SA3. The suction regions SA1, SA2, and SA3 are arranged in the second direction D2.

The shutters SHU are disposed on a lower portion of the second housing HOS2 so as to open and close lower portions of the suction regions SA1, SA2, and SA3. As seen in FIG. 3, each of the shutters SHU includes a first shutter SHU1 and a second shutter SHU2 that face each other in the first direction D1. Hereinafter, operations of the first and second shutters SHU1 and SHU2 will be described in detail with reference to FIGS. 4A and 4B, which are views illustrating an opening/closing operation of a shutter of FIGS. 2 and 3.

Figure 5:
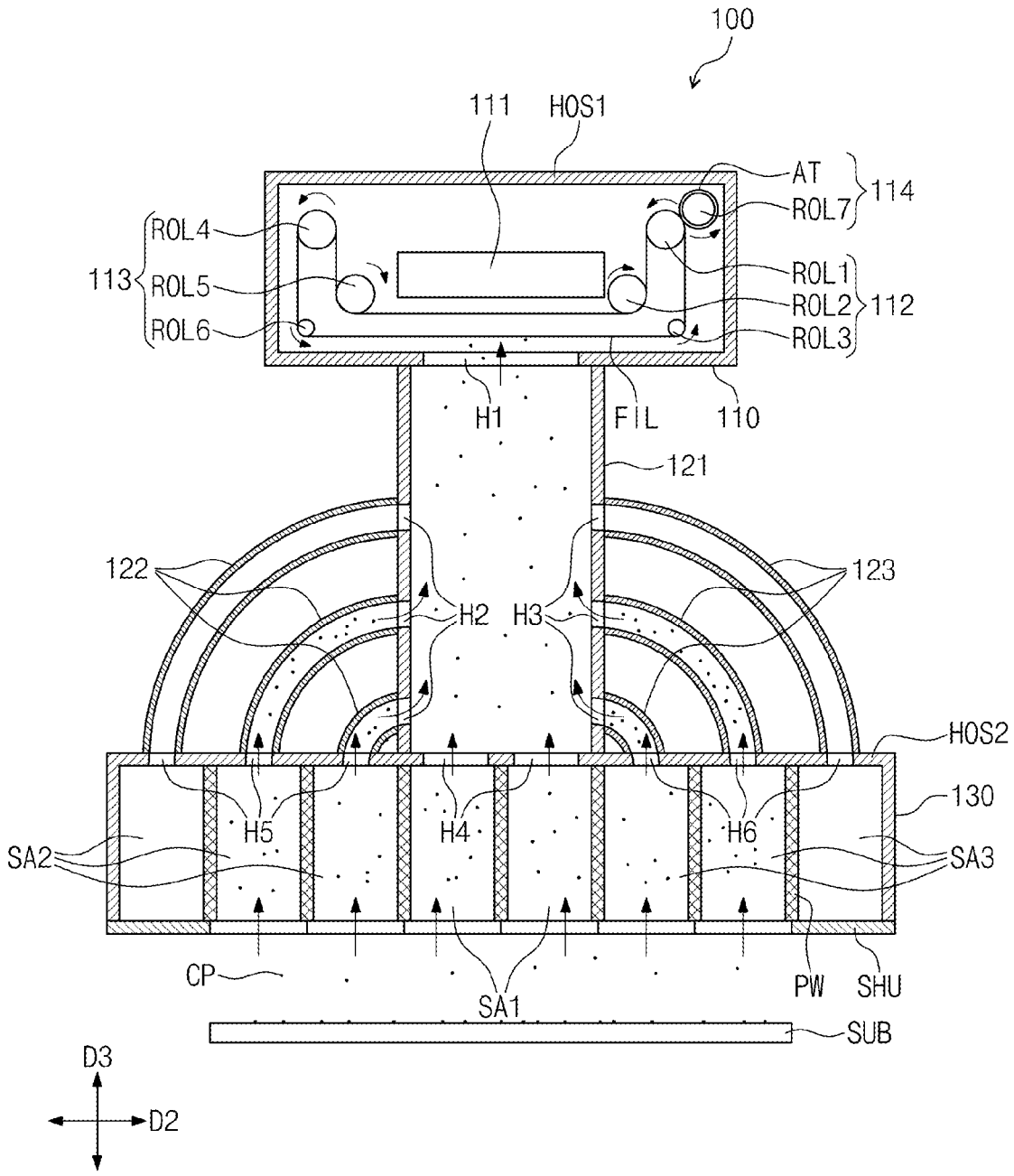
FIG. 5 is a view illustrating an operation of the substrate cleaning apparatus of FIG. 1.

The suction regions SA1, SA2, and SA3 include a plurality of first suction regions SA1, a plurality of second suction regions SA2, and a plurality of third suction regions SA3 (see FIGS. 2, 3 and 5).

The first suction regions SA1 are defined so as to correspond to the first suction tube 121 and are connected to the first suction tube 121. The second suction regions SA2 are defined so as to respectively correspond to the second suction tubes 122 and are respectively connected to the second suction tubes 122. The third suction regions SA3 are defined so as to respectively correspond to the third suction tubes 123 and are respectively connected to the third suction tubes 123.

In FIG. 2, two first suction regions SA1, three second suction regions SA2, and three third suction regions SA3 are illustrated for convenience in description. However, it is not limited thereto, and for example, partitions PW more than those illustrated in FIG. 2 may be used to define first to third suction regions more than those of the first to third suction regions SA1 to SA3 illustrated in FIG. 2.

The second housing HOS2 includes a plurality of fourth holes H4, a plurality of fifth holes H5, and a plurality of sixth holes H6 defined in a top surface of the second housing HOS2. The fourth holes H4 correspond to the first suction regions SA1, respectively. The fifth holes H5 correspond to the second suction regions SA2, respectively. The sixth holes H6 correspond to the third suction regions SA3, respectively.

The first suction tube 121 has a lower portion corresponding to the first suction regions SAL The lower portion of the first suction tube 121 is connected to an upper portion of the first suction regions SAL Each of the second suction tubes 122 has a side that is connected to each of the fifth holes H5 corresponding thereto. Each of the third suction tubes 123 has the other side that is connected to each of the sixth holes H6 corresponding thereto.

The first suction regions SA1, the fourth holes H4, the first suction tube 121, and the first hole H1 may define a moving path through which the contamination particles suctioned from the first suction regions SA1 move into the suction unit 110.

The second suction regions SA2, the fifth holes H5, the second suction tubes 122, the second holes H2, and the first hole H1 may define a moving path through which the contamination particles suctioned from the second suction regions SA2 move into the suction unit 110.

The third suction regions SA3, the sixth holes H6, the third suction tubes 123, the third holes H3, and the first hole H1 may define a moving path through which the contamination particles suctioned from the third suction regions SA3 move into the suction unit 110.

Figure 4A:
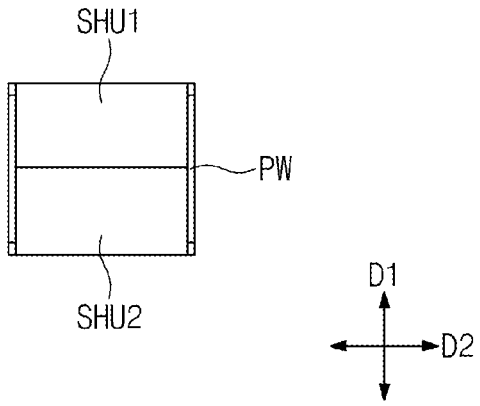
FIGS. 4A and 4B are views illustrating an opening/closing operation of a shutter of FIGS. 2 and 3.
Figure 4B:
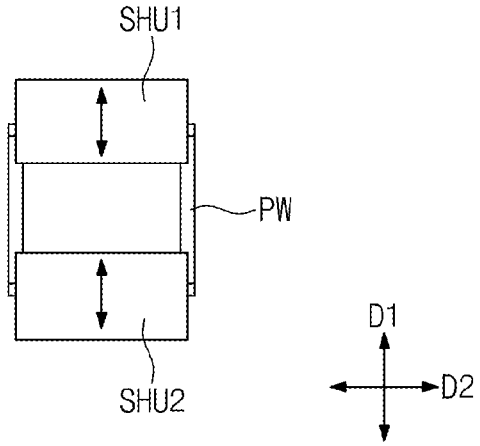

FIGS. 4A and 4B are views illustrating an opening/closing operation of the shutter of FIGS. 2 and 3.

In FIGS. 4A and 4B, a lower portion of one suction region is illustrated for convenience in description. However, the shutters disposed on lower portions of other suction regions may operate in the same manner.

Referring to FIGS. 4A and 4B, each of the first and second shutters SHU1 and SHU2 is reciprocated in the first direction D1. Also, the first and second shutters SHU1 and SHU2 move in a direction opposite to each other.

The first and second shutters SHU1 and SHU2 move so as to contact each other in the first direction D1, thereby closing the suction region SA. The first and second shutters SHU1 and SHU2 move to far away from each other in the first direction D1, thereby opening the suction region SA.

Although the first and second shutters SHU1 and SHU2 are exemplarily illustrated, the shutters will not be limited to the structure thereof. For example, one shutter may be reciprocated in the first direction D1 so as to open and close the suction region.

FIG. 5 is a view illustrating an operation of the substrate cleaning apparatus of FIG. 1.

For convenience in description, the cross-sectional view of the substrate cleaning apparatus of FIG. 2 is used in FIG. 5.

Referring to FIG. 5, the substrate SUB is disposed under the suction head 130 of the substrate cleaning apparatus 100. As described above, the substrate SUB may be transferred in the first direction D1.

The suction force generation part 111 generates the suction force. The suction force is transmitted to the suction regions SA1, SA2, and SA3 of the suction head 130 through the first to third suction tubes 121, 122, and 123.

The shutters SHU may operate to open the lower portions of the suction regions SA1, SA2, and SA3 which correspond to a width of the substrate SUB in the second direction D2. For example, as illustrated in FIG. 5, the width of the substrate SUB in the second direction D2 corresponds to the total width of the first suction regions SA1, two second suction regions SA2 adjacent to a left side of the first suction regions SA1, and two third suction regions SA3 adjacent to a right side of the first suction regions SA1.

In this case, the second suction region SA2 defined at the leftmost side and the third suction region SA3 defined at the rightmost side in the second direction D2 are not used. Thus, the lower portions, which correspond to the width of the substrate SUB in the second direction D2, of the first suction regions SA1, two second suction regions SA2 adjacent to a left side of the first suction regions SA1, and two third suction regions SA3 adjacent to a right side of the first suction regions SA1 may be opened by the shutters SHU.

In the embodiments of the invention, only the shutters corresponding to the suction regions SA1, SA2, and SA3 that correspond to the width of the substrate SUB may operate without operating all of the shutters corresponding to the suction regions SA1, SA2, and SA3. Therefore, according to the embodiments, power consumption may be reduced when compared to a case in which all of the shutters corresponding to the suction regions SA1, SA2, and SA3 operate.

The contamination particles CP on the substrate SUB may be suctioned through the lower portions of the suction regions SA1, SA2, and SA3 corresponding to the width of the substrate SUB in the second direction D2. The contamination particles CP may be provided to the suction unit 110 through the moving path of the above-described contamination particles CP. In FIG. 5, a moving state of the contamination particles CP is illustrated with an arrow for convenience in description.

The filter FIL moves via the lower portion of the suction force generation part 111. The filter FIL has the width greater than the suction force generation part 111 in the first direction D1. Thus, the contamination particles CP may pass through the first hole H1 of the suction unit 110 and be filtered through the filter FIL, but the contamination particles CP may not be provided to the suction force generation part 111.

The filter FIL moves in a predetermined direction according to a rotation direction of each of the first to sixth rollers ROL1 to ROL6. In FIG. 5, rotation directions of the first to seventh rollers ROL1 to ROL7 are illustrated with arrows in clockwise and counterclockwise directions. Hereinafter, the counterclockwise direction is defined as a first rotation direction RD1, and the clockwise direction is defined as a second rotation direction RD2.

In an exemplary embodiment, the filter FIL having the closed loop shape may move in the counterclockwise direction. To allow the filter FIL having the closed loop shape to move in the counterclockwise direction, the first roller ROL1 rotates in the first rotation direction RD1.

In this case, the second roller ROL2 may rotate in the second rotation direction RD2, and the third roller ROL3 may rotate in the first rotation direction RD1. Also, the fourth and sixth rollers ROL4 and ROL6 may rotate in the first rotation direction RD1, and the fifth roller ROL5 may rotate in the second rotation direction RD2.

That is, the first, third, fourth, and sixth rollers ROL1, ROL3, ROL4, and ROL6 may rotate in the same direction. The second and fifth rollers ROL2 and ROL5 may rotate in a direction opposite to that of the first, third, fourth, and sixth rollers ROL1, ROL3, ROL4, and ROL6.

The contamination particles CP filtered through the filter FIL may move together with filter FIL in a state where the contamination particles CP are adsorbed onto the filter FIL. The seventh roller ROL 7 rotates in the second rotation direction RD2. As described above, the adhesion member AT rotating by the seventh roller ROL7 may contact the filter FIL moving by the first roller ROL1.

When the filter FIL moves to the first roller ROL1, the contamination particles CP adsorbed onto the filter FIL may be adhered to the adhesion member AT rotating by the seventh roller ROL7 and may be removed from the filter FIL. That is, the contamination particles CP adsorbed onto the filter FIL may be transferred to the adhesion member AT due to an adhesion force of the adhesion member AT, and may be removed from the filter FIL.

Since the contamination particles CP are continuously adhered onto the adhesion member AT, the adhesion member AT may be deteriorated in adhesion force. The adhesion member AT deteriorated in adhesion force may be removed from the seventh roller ROL7. Then, new adhesion member AT may be disposed on the seventh roller ROL7. That is, the adhesion member AT may be periodically replaced.

The suction force may be transmitted to the suction tubes 121, 122, and 123, and the suction head 130 via the filter FIL. Thus, when the adhesion member AT is not used, the contamination particles CP are adhered onto the filter FIL so as to reduce the suction force for suctioning the contamination particles CP. Also, since the contamination particles CP are adhered onto the filer FIL, the filter FIL may be periodically replaced so as to reduce the lifespan of the filter FIL.

However, in the embodiments of the invention, the contamination particles CP are removed by the adhesion member AT, and the suction force for suctioning the contamination particles CP may not be reduced. Also, the adhesion member AT, which is cheaper than the filter FIL, is replaced so as to improve the lifespan of the filter FIL.

As a result, the substrate cleaning apparatus 100 according to embodiments of the invention may efficiently clean the substrate.

The substrate cleaning apparatus according to the invention may efficiently clean the substrate.

While this invention has been particularly shown and described with reference to preferred embodiments thereof, it will be understood by those skilled in the art that various changes in form and detail may be made therein without departing from the spirit and scope of the invention as defined by the appended claims. The preferred embodiments should be considered in a descriptive sense only, and not for purposes of limitation. Therefore, the scope of the invention is defined not by the detailed description of the invention but by the appended claims, and all technical concepts within the scope will be construed as being included in the invention.

What is claimed is:

1. An apparatus for cleaning a substrate, the apparatus comprising:

a suction unit generating a suction force;

a suction head suctioning contamination particles remaining on the substrate that is transferred in a first direction by using the suction force; and a suction tube connected to the suction unit and the suction head so as to transfer the suction force into the suction head, and providing the contamination particles suctioned by the suction head into the suction unit;

wherein the suction head comprises:

a plurality of suction regions arranged in a second direction crossing the first direction; and a plurality of shutters for opening and closing the suction regions;

wherein the suction regions corresponding to a width of the substrate in the second direction are opened by the shutters so as to suction the contamination particles.

2. The apparatus of claim 1, wherein each of the shutters comprises a first shutter and a second shutter that are reciprocated in the first direction, and the first and second shutters move in a direction opposite to each other.

3. The apparatus of claim 1, wherein the suction head further comprises a plurality of partition walls for partitioning the suction head into the suction regions.

4. The apparatus of claim 1, wherein the suction unit comprises:

a suction force generation part for generating the suction force;

a filter having a closed loop shape, the filter filtering the contamination particles;

first and second roller parts disposed with the suction force generation part therebetween in the second direction so as to move the filter in a predetermined direction; and a third roller part disposed adjacent to the first roller part so as to remove the contamination particles adsorbed onto the filter;

wherein the filter moves via a lower portion of the suction force generation part.

5. The apparatus of claim 4, wherein the suction force generation part comprises a rotor.

6. The apparatus of claim 4, wherein the filter is a porous filter.

7. The apparatus of claim 4, wherein the first roller part comprises:

a first roller generating a rotation force;

a second roller disposed lower than the first roller; and a third roller disposed lower than the second roller;

wherein each of the first, second and third rollers has a cylindrical shape extending in the first direction, the second roller is disposed more adjacent to the suction force generation part than the first roller, and the third roller overlaps the first roller in a third direction crossing the first and second directions.

8. The apparatus of claim 7, wherein a lowermost spot of an outer circumferential surface of the second roller is disposed lower than a bottom surface of the suction force generation part.

9. The apparatus of claim 7, wherein the second roller part comprises fourth, fifth and sixth rollers that respectively correspond to the first, second and third rollers, wherein each of the fourth, fifth and sixth rollers has the same shape as that of each of the first, second and third rollers corresponding thereto, and is symmetrical to each of the first, second and third rollers corresponding thereto with respect to the suction force generation part in the second direction; and wherein the filter moves along an outer circumferential surface of each of the first to sixth rollers in a predetermined direction by rotation of each of the first to sixth rollers.

10. The apparatus of claim 9, wherein the filter contacts an upper outer circumferential surface of the first roller, a right-lower outer circumferential surface of the second roller, a right-lower outer circumferential surface of the third roller, an upper outer circumferential surface of the fourth roller, a left-lower outer circumferential surface of the fifth roller, and a left-lower outer circumferential surface of the sixth roller so as to move.

11. The apparatus of claim 9, wherein the first, third, fourth, and sixth rollers rotate in a first rotation direction, and the second and fifth rollers rotate in a second rotation direction which is opposite to the first rotation direction.

12. The apparatus of claim 7, wherein each of the first to third rollers has a width greater than that of the filter in the first direction, and the filter has a width greater than that of the suction force generation part in the first direction.

13. The apparatus of claim 7, wherein the third roller part comprises:

a seventh roller disposed adjacent to the first roller; and an adhesion member disposed on an outer circumferential surface of the seventh roller;

wherein the seventh roller rotates in a direction opposite to that of the first roller, and the adhesion member is in contact with the filter that moves by the first roller.

14. The apparatus of claim 13, wherein the contamination particles adsorbed onto the filter moving by the first roller are transferred to the adhesion member due to an adhesion force of the adhesion member, and are removed from the filter.

15. The apparatus of claim 13, wherein the adhesion member is periodically replaced.

16. The apparatus of claim 13, wherein the adhesion member comprises an adhesion tape.

17. The apparatus of claim 4, wherein the suction regions comprise:

a plurality of first suction regions;

a plurality of second suction regions arranged at a left side of the first suction regions in the second direction; and a plurality of third suction regions arranged at a right side of the first suction regions in the second direction.

18. The apparatus of claim 17, wherein the suction tube comprises:

a first suction tube connected to the first suction regions and to a central portion of a bottom surface of the suction unit;

a plurality of second suction tubes connected to the second suction regions corresponding thereto and to one side surface of the first suction tube in the second direction; and a plurality of third suction tubes connected to the third suction regions corresponding thereto and to another side surface of the first suction tube in the second direction.

19. The apparatus of claim 18, wherein the first suction tube defines a moving path through which the contamination particles suctioned from the first suction regions move into the suction unit;

wherein the second suction tubes define moving paths through which the contamination particles suctioned from the second suction regions move into the suction unit; and wherein the third suction tubes define moving paths through which the contamination particles suctioned from the third suction regions move into the suction unit.

20. The apparatus of claim 18, wherein the filter has a width greater than a width of the first suction tube in the first direction.

* * * * *